US009433813B1

(12) United States Patent
Cervantez

(10) Patent No.: US 9,433,813 B1
(45) Date of Patent: Sep. 6, 2016

(54) LOWER BODY STRENGTH TRAINING DEVICE

(71) Applicant: Mcor Cervantez, Pico Rivera, CA (US)
(72) Inventor: Mcor Cervantez, Pico Rivera, CA (US)

( * ) Notice: Subject to any disclaimer, the term of this patent is extended or adjusted under 35 U.S.C. 154(b) by 0 days.
(21) Appl. No.: 14/696,070
(22) Filed: Apr. 24, 2015
Related U.S. Application Data
(60) Provisional application No. 61/984,410, filed on Apr. 25, 2014.
(51) Int. Cl.
*A63B 26/00* (2006.01)
*A63B 21/00* (2006.01)
(52) U.S. Cl.
CPC ..... *A63B 21/00047* (2013.01)
(58) Field of Classification Search
CPC ..... A63B 5/08; A63B 5/11; A63B 5/16; A63B 2005/085; A63B 6/00; A63B 21/00047; A63B 21/00185; A63B 21/0604; A63B 21/0605; A63B 21/068; A63B 21/4027; A63B 21/4029; A63B 21/4034; A63B 21/4037; A63B 2022/0038; A63B 2022/0092; A63B 2022/185; A63B 22/0046; A63B 22/14; A63B 22/16; A63B 22/18; A63B 23/03508; A63B 23/04; A63B 23/0405; A63B 23/0458; A63B 23/0482; A63B 23/0488; A63B 23/0494; A63B 26/003; A63B 69/0022; A63B 69/0028; A63B 69/0035; A63B 71/0036; A63B 2208/0204; A63B 2208/0209; A63B 2210/10; A63B 2210/50; A63B 2225/09; A63B 2225/093; A63B 2225/10; A63B 2225/102; A63B 2225/105; A63B 2225/107; A63B 2244/08; A63B 2244/087; A63B 2244/18
USPC ..... 482/907, 52
See application file for complete search history.

(56) References Cited

U.S. PATENT DOCUMENTS 3,253,375 A * 5/1966 Takehara ..... E04C 2/322 52/11
4,730,826 A * 3/1988 Sudmeier ..... A63B 5/11 482/28
4,940,226 A * 7/1990 Carra ..... A63B 69/0022 434/253
5,114,387 A * 5/1992 Keppler ..... A63B 21/4037 434/253
5,284,465 A * 2/1994 Homan, Jr. ..... A63B 21/00047 482/148
5,326,338 A * 7/1994 Makous ..... A63B 69/0022 434/253
5,354,247 A * 10/1994 Wilkinson ..... A47C 3/20 206/505
5,879,272 A * 3/1999 Mekjian ..... A63B 69/0035 482/131
5,925,000 A * 7/1999 Marciniak ..... A43B 7/24 482/8
6,162,061 A * 12/2000 Taylor ..... A63B 5/11 434/253
8,992,389 B2 * 3/2015 Abel ..... A63B 69/0057 482/51
2007/0219076 A1 * 9/2007 Axelrod ..... A63B 26/003 482/148
2012/0184412 A1 * 7/2012 Glaner ..... A63B 69/18 482/30
2013/0217552 A1 * 8/2013 Slotnick ..... A63B 22/20 482/142
2014/0031183 A1 * 1/2014 Blake ..... A63B 21/04 482/130
2014/0256525 A1 * 9/2014 Mueller ..... A61H 1/0237 482/142

* cited by examiner

*Primary Examiner* — Oren Ginsberg
*Assistant Examiner* — Gary D Urbiel Goldner
(74) *Attorney, Agent, or Firm* — Kenneth L. Green; Averill & Green

(57) ABSTRACT

A lower body strength training method and equipment facilitates safely building muscles and coordination. The method and equipment provides an efficient and safe work-out to increase leg strength and speed in lateral movement. The method and equipment may be configured for a lateral exercise and for a vertical step exercise. The equipment included two ramps positionable opposing each other for the lateral exercise, and the ramps may be joined for the vertical step exercise.

10 Claims, 2 Drawing Sheets

LOWER BODY STRENGTH TRAINING DEVICE

CROSS-REFERENCE TO RELATED APPLICATIONS

The present application claims the priority of U.S. Provisional Patent Application Ser. No. 61/984,410 filed Apr. 25, 2014, which application is incorporated in its entirety herein by reference.

BACKGROUND OF THE INVENTION

The present invention relates to lower body exercises and in particular to a ramp and platform system providing at least two modes of exercise.

In many sports, lateral movement and explosive leg strength is extremely important. Unfortunately, there is a lack of training techniques and equipment for improvement in this area. Using techniques and equipment not designed for this specific work out will not provide desired results and may result in injury.

BRIEF SUMMARY OF THE INVENTION

The present invention addresses the above and other needs by providing a lower body strength training method and equipment which facilitates safely building muscles and coordination. The method and equipment provides an efficient and safe workout to increase leg strength and speed in lateral movement. The method and equipment may be configured for a lateral exercise and for a vertical step exercise. The equipment included two ramps positionable opposing each other for the lateral exercise, and the ramps may be joined for the vertical step exercise.

In accordance with one aspect of the invention, there are provided exercise ramps positionable opposite to each other, sloping down towards each other. A user springs from side to side, from right to left foot, building strength and balance.

In accordance with another aspect of the invention, there are provided exercise ramps stackable to construct a platform. A user steps up onto the platform with the right and then left foot, building strength.

In accordance with yet another aspect of the invention, there are provided exercise ramps stackable to form a platform. The exercise ramps may thus be used for multiple exercises.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
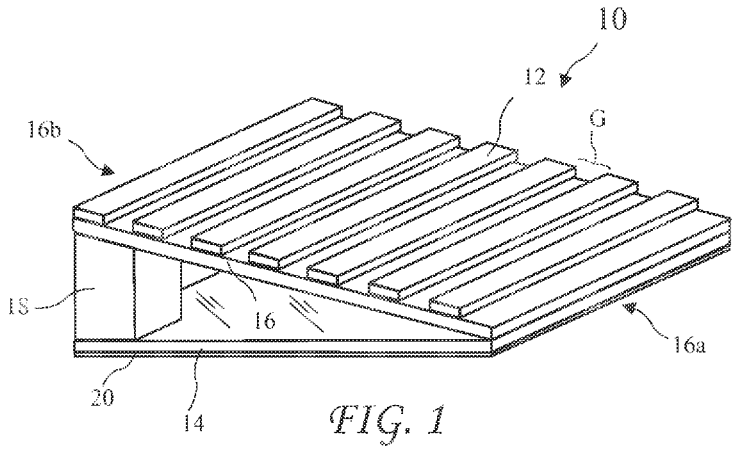
FIG. 1 is a perspective view of an exercise ramp according to the present invention.

A perspective view of an exercise ramp 10 according to the present invention is shown in FIG. 1. The exercise ramp 10 includes a base 14, a ramp 16 directly attached to the base 14 along a front 16*a* and supported by three spacers 18 between the base 14 and ramp 16 along a rear edge 16*b*. Slats 12 are attached on top of the ramp 16, and spaced apart by a gap G. The slats 12 are preferably 1¼ inches wide and the gaps are preferably 1⁵⁄₁₆ inches wide and may be a solid wood. A rubber mat 20 may be attached to the bottom of the base 14 to resist sliding when in use.

Figure 2B:
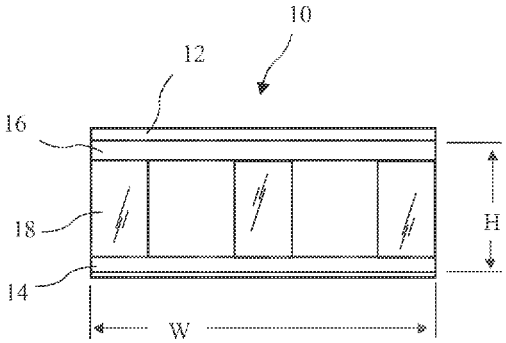
FIG. 2B is a rear view of the exercise ramp according to the present invention.
Figure 2A:
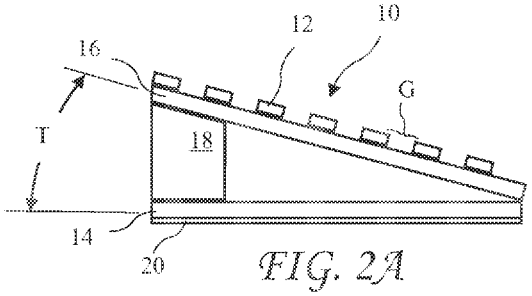
FIG. 2A is a side view of the exercise ramp according to the present invention.
Figure 2C:
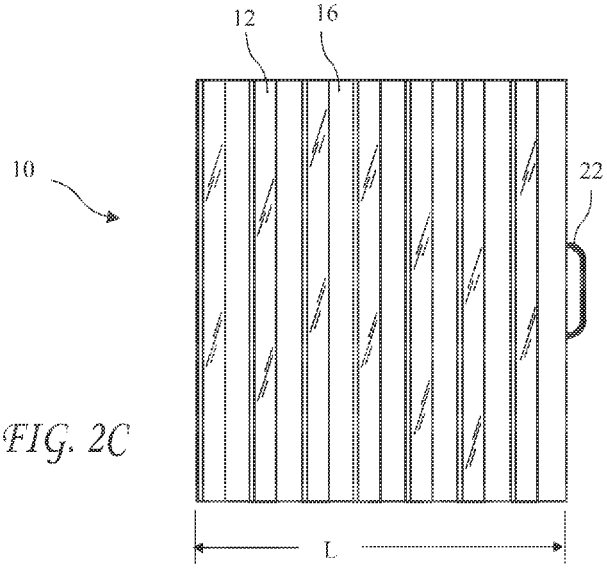
FIG. 2C is a top view of the exercise ramp according to the present invention.

A side view of the exercise ramp according to the present invention, a rear view of the exercise ramp 10 is shown in FIG. 2B, and a top view of the exercise ramp 10 is shown in FIG. 2C. The ramp 16 and base 14 may be ¾ inch thick plywood and the three spacers 18 may be cut from 4 by 4 lumber. A handle 22 may be provided for carrying.

The exercise ramp has a tilt T, a height H, a width W, and a length L. The tilt T is preferably between 14 and 17 degrees, and more preferably 15 degrees, the height H is preferably between 4½ and six inches, and more preferably 5.75 inches, the length L is preferably between 16 and 18 inches and more preferably 17½ inches, and the width W is preferably between 22 and 26 inches, and more preferably 24 inches.

Figure 3B:
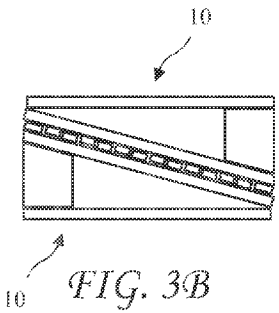
FIG. 3B shows two exercise ramp engaged according to the present invention.
Figure 5:
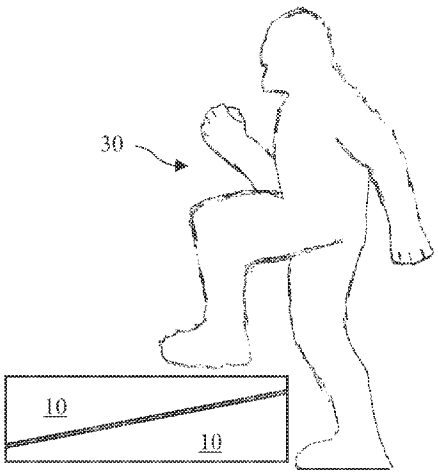
FIG. 5 shows a user performing a stepping exercise on the exercise ramps according to the present invention.
Figure 3A:
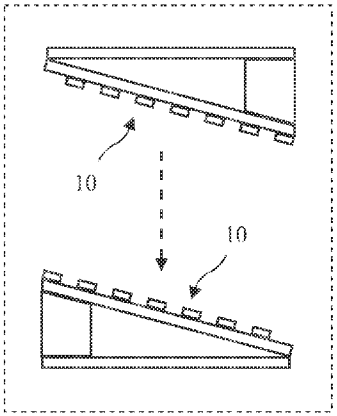
FIG. 3A shows two exercise ramps aligned for engagement according to the present invention.

FIG. 3A shows two exercise ramps 10 aligned for engagement and FIG. 3B shows two exercise ramps 10 engaged. The gaps G are slightly wide than the slats 12 and the widths of the slats 12 and gaps G provide the engagement of the ramps 10 preventing the ramps from sliding apart when used as a step.

Figure 4:
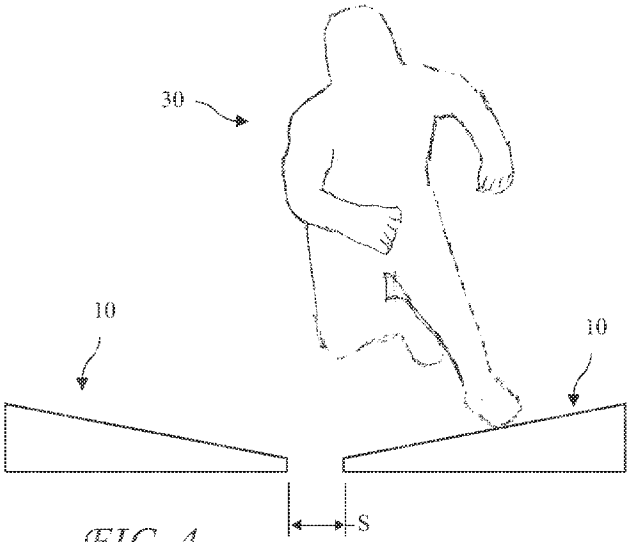
FIG. 4 shows a user performing a lateral exercise on the exercise ramps according to the present invention.

A user 30 is shown performing a lateral exercise on the exercise ramps 10 in FIG. 4. The user 30 positions the ramps 10 opposed to each other, with the front edges 16*a* of the ramps 10 facing inward separated by a spacing S of preferably 12 inches. The user 30 springs from one ramp 10 to the opposite ramp 10 to perform the lateral exercise.

A user 30 performing a stepping exercise on the exercise ramps 10 engaged to provide a step.

While the invention herein disclosed has been described by means of specific embodiments and applications thereof, numerous modifications and variations could be made thereto by those skilled in the art without departing from the scope of the invention set forth in the claims.

I claim:

1. A method for a user to perform a lower body exercise, comprising:

positioning first and second ramps on a floor facing each other with lower front edges of each of the first and second ramps facing inward and higher outer edges of each of the first and second ramps facing outward, the first and second ramps including spaced apart slats on a top surface of each ramp, gaps between the slats of each ramp having a spacing slightly wider than a width of the slats;

leaving a spacing between the lower front edges of each of the first and second ramps;

the user facing perpendicular to the spacing;

the user performing a lateral exercise comprising:

the user stepping on the first ramp with a first foot closest to the first ramp;

the user springing off the first ramp and landing on the second ramp with a second foot closest to the second ramp; and the user continuing the lateral exercise springing back and forth between the first and second ramps.

2. The method of claim 1, the method further including:

lifting the second ramp;

inverting the second ramp and positioning it above the first ramp, lowering the second ramp to contact the first ramp;

engaging the slats of the first ramp into the gaps of the second ramp and the slats of the second ramp into the gaps of the first ramp;

aligning the first and second ramps to form a step;

the user stepping onto the step with a first leg and the first foot;

the user performing a vertical step exercise comprising:

the user straightening the first leg to lift the second foot from the floor to exercise leg muscles of the first leg;

the user stepping back to the floor with both feet; and the user repeating the vertical step exercise using leg muscles of a second leg of the user.

3. The method of claim 1, wherein the first and second ramps have a tilt between 14 and 17 degrees.

4. The method of claim 3, wherein the first and second ramps have a width between 22 and 26 inches.

5. The method of claim 3, wherein the first and second ramps have a length between 16 and 18 inches.

6. The method of claim 1, wherein the first and second ramps have a height between 4½ and six inches.

7. The method of claim 1, wherein the slats of each ramp are between ¾ and 1½ inches wide.

8. The method of claim 1, wherein the gaps between the slats of each ramp are between 1/16 and ¼ inches wider than the slats.

9. A method for a user to perform a lower body exercise, comprising:

obtaining first and second ramps, each of the ramps having:

a tilt between 14 and 17 degrees;

a width between 22 and 26 inches;

a length between 16 and 18 inches; and slats residing on a top surface of each of the ramps, each of the slats between ¾ and 1½ inches wide and separated by gaps between 1/16 and ¼ inches wider than the slats;

positioning the first and second ramps on a floor facing each other with lower front edges of each of the first and second ramps facing inward and higher outer edges of each of the first and second ramps facing outward;

leaving a spacing between the lower front edges of each of the first and second ramps;

the user facing perpendicular to the spacing;

the user stepping on the first ramp with a first foot closest to the first ramp;

the user springing off the first ramp and landing on the second ramp with a second foot closest to the second ramp; and the user continuing the exercise springing back and forth between the first and second ramps.

10. A method for a user to perform a lower body exercise, comprising:

obtaining first and second ramps, each of the ramps having:

a tilt of 15 degrees;

a width of 24 inches;

a length of 17½ inches; and seven slats residing on a top surface of each of the ramps, each of the seven slats being 1¼ inches wide and separated by 1 5/16 inch wide gaps;

positioning the first and second ramps on a floor facing each other with lower front edges of each of the first and second ramps facing inward and higher outer edges of each of the first and second ramps facing outward;

leaving a spacing between the lower front edges each of the first and second ramps;

the user facing perpendicular to the spacing;

the user stepping on the first ramp with a first foot closest to the first ramp;

the user performing a lateral exercise comprising:

the user springing off the first ramp and landing on the second ramp with a second foot closest to the second ramp; and the user continuing the lateral exercise springing back and forth between the first and second ramps;

the user completing the lateral exercise;

lifting the second ramp;

inverting the second ramp and positioning it above the first ramp, lowering the second ramp to contact the first ramp;

engaging the slats of the first ramp into the gaps of the second ramp and the slats of the second ramp into the gaps of the first ramp;

aligning the first and second ramps to form a step;

the user performing a vertical step exercise comprising:

the user stepping onto the step with a first leg and the first foot;

the user straightening the first leg to lift the second foot from the floor to exercise leg muscles of the first leg;

the user stepping back to the floor with both feet; and the user repeating the vertical step exercise using leg muscles of a second leg of the user.

* * * * *